US005421252A

United States Patent [19]

Reichel

[11] Patent Number: 5,421,252

[45] Date of Patent: Jun. 6, 1995

[54] WASTE CONTAINER SYSTEM WITH COMPACTING ARM

[76] Inventor: Günter Reichel, Steinhardtweg 9, D-35232 Dautphetal, Germany

[21] Appl. No.: 186,986

[22] Filed: Jan. 28, 1994

[30] Foreign Application Priority Data

May 21, 1993 [DE] Germany ..... 93 07 748.3 U

[51] Int. Cl.[6] ..... B30B 1/00; B65F 1/00

[52] U.S. Cl. ..... 100/193; 100/226; 100/229 A; 100/233; 220/909

[58] Field of Search ..... 100/193, 221, 226, 227, 100/229 A, 233, 240, 293; 220/521, 522, 558, 908, 909; 232/43.2, 43.3; 312/212, 319.9

[56] References Cited

U.S. PATENT DOCUMENTS

| | | | |
|---|---|---|---|
| 2,386,929 | 10/1945 | Brown | 312/319.9 |
| 2,593,455 | 4/1952 | James | 220/909 |
| 2,970,533 | 2/1961 | Allen | 100/229 A |
| 3,202,346 | 8/1965 | Jacobs | 100/233 |
| 3,357,346 | 12/1967 | Crafoord | 100/229 A |

FOREIGN PATENT DOCUMENTS

| | | | |
|---|---|---|---|
| 764207 | 8/1967 | Canada | 100/226 |
| 2419369 | 11/1975 | Germany . | |
| 2446894 | 5/1976 | Germany . | |
| 7737376 | 9/1978 | Germany . | |
| 7813581 | 10/1978 | Germany . | |
| 3333316 | 3/1983 | Germany | 220/908 |
| 8706920.2 | 8/1987 | Germany . | |
| 4006067 | 8/1991 | Germany | 220/909 |
| 4013107 | 10/1991 | Germany . | |

*Primary Examiner*—Stephen F. Gerrity
*Attorney, Agent, or Firm*—Lowe, Price, LeBlanc & Becker

[57] ABSTRACT

A waste container system includes a receptacle box having side walls that define a storage space, at least one individual container positioned within the receptacle box, each container being forwardly-tiltable, having an open top and being removable from the receptacle box, a cover attached to the side and rear walls of the receptacle box, and a compacting arm mounted on the underside of the cover above the open top of each container. The compacting arm is slidable and pivotable with respect to the underside of the cover into a position which permits downward manual compaction of the contents of an individual container.

17 Claims, 6 Drawing Sheets

WASTE CONTAINER SYSTEM WITH COMPACTING ARM

BACKGROUND OF THE INVENTION

1. Field of the Invention The present invention relates to a waste container system.

2. Description of the Prior Art

For collecting a wide variety of waste types, hereafter simply referred to as waste, various containers such as baskets, buckets, bins etc. are generally used. Indoors, small metal or plastic containers are usual, which can be lined with bags or sacks. The waste, generally collected loose, is transferred to larger containers, the emptying of which is generally organized by the public waste disposal services. Since large air pockets are often found amongst the waste, the containers frequently overflow; in addition, further shuttle trips by the emptying service are necessary, even if these vehicles are equipped with crushing devices, which can in the end only achieve an inadequate compacting effect.

To remove larger quantities each time in an economical process, the waste in the containers must be compressed beforehand. In this connection, DE-U-7 813 581 describes as an independent unit a compacting plate with a handgrip on the back. This handgrip enables the plate to be pressed into the household waste container without soiling the hands or clothing of the user, which operation is easy enough to accomplish only when the container is full, but then requires considerable bodily strength.

In a pressing device according to DE-A-4 013 107, a pushing lever gear unit can be folded together to conform to the design height of a lifting cylinder, and permits a pressing plate to be extended that can exert greater forces. In addition, lever presses have been proposed, for example, in DE-U-7 737 376 and DE-U-8 706 920, comprising a relatively heavy mechanism that projects quite a large distance. The same applies also to other waste presses, such as described in DE-A-2 419 369. All these devices require oversize and sturdy containers in view of the sometimes very high compression forces.

DE-A-2 446 894 discloses a waste container disposed in a recess, box or the like, and tiltable and removable therefrom, above which container a compactor is located with two motor-driven pairs of pressing rollers, the lower roller gap ejecting crushed cans, for example, into the adjacent container opening. Frequently, however, the receptacle height required by the added pressing mechanism is not available, and this mechanism with its drive unit is furthermore expensive.

Further developments have concentrated on separate collection of different waste types in sorting containers in order to permit material recycling.

SUMMARY OF THE INVENTION

It is a general object of the invention to provide for better possibilities of interim storage, in particular of household waste, with low space requirement and moderate expense so that waste disposal is economical and free of bother. Specifically, the invention aims at creating an improved waste container system that is, above all, suitable for home use where interim storage of different and separable types of waste are to be collected and to be disposed of in a simple manner. A further object of the invention consists in providing a waste container system whose use is largely foolproof. Yet another aspect of the invention aims at a clearcut design warranting that collecting of waste and emptying of the container(s) used require little effort and be as hygienic as possible.

In a waste container system with a receptacle box, which has a stowage space generally enclosed by walls and by a cover, for at least one forward-tiltable and removable individual container located underneath a compactor, the invention provides for the compactor to be designed as a manual pressing plate that moves forwards under the cover and swings downwards into the forward-tilted individual container in a front limit position. This arrangement is extremely simple and easy to use. Since motor drive units are not provided, the expense of acquiring it is greatly reduced, so that a system of this type can be purchased by any household thanks to its inexpensive manufacture. Its use requires only moderate muscular exertion, which can compress the deposited waste into relatively small portions.

In accordance with one embodiment, the individual containers and manual pressing plate have a substantially oblong basic form and therefore form a kind of narrow insert. On each side of the narrow rear portion, the manual pressing plate in accordance with another embodiment has a sliding bearing that doubles as a pivot bearing in the front limit position. This particularly simple design is equally advantageous both for production and assembly, and is as easy to use as it is to care for.

In accordance with another embodiment, the manual pressing plate has sliding grooves disposed on lateral rails and having inner run-out ends that leave the rails in the front limit position, as a result of which the swing-down movement of the manual pressing plate about the sliding bearing is enabled. In accordance with another embodiment, the sliding bearings of the manual pressing plate are ideally guided laterally by parallel strips, rails or the like underneath the cover. Another embodiment provides for the sliding bearings to be designed as sliding heads projecting on both sides of the manual pressing plate, e.g. from a rod located on the rear narrow side. It can be seen that the clear design is very inexpensive to make.

In accordance with another embodiment, the manual pressing plate has on its underside a pressing element which projects inwards/downwards and which, in accordance with another embodiment, can be designed on its upper side as a recess with grip that is accessible from above/outside when the manual pressing plate is in the forward-moved position, and can therefore double as both pressing surface and lifting handle.

In accordance with another embodiment, the pressing element is designed flexible in the inward/downward direction and/or is provided with a stop. The flexible design ensures distribution of the forces or pressure during the pressing operation, so that the edge areas inside the individual container are compacted too. The stop can double as a driver, in that the upper rear edge of the individual container pulls the manual pressing plate forwards when it is tilted forwards, in accordance with another embodiment. In accordance with another embodiment, the pressing element can support or form the stop at the rear. It can be seen that merely opening the individual container also moves the manual pressing plate forwards, where it can then be pulled out further by hand and swung downwards to carry out the pressing operation.

In accordance with another embodiment, the individual container is supported by means of a depression provided at the front and on the bottom and resting on a rib of a pedestal inside the receptacle box said rib acting as a tilting bearing This particularly simple design allows removal of the individual container at any time, and automatic relocation on its tilting bearing when it is put back inside.

An important embodiment consists in accordance with another embodiment of a front plate of the individual container having at the top a sealing stop that engages with the front edge of the cover while the container is in its rest position. This ensures that odours are kept inside, without in any way hampering the opening and closing action of the waste container.

In accordance with another embodiment, the individual container can be tilted optionally using a pedal strip or a handle and/or removed using a carrying handle. This ensures a very simple operation.

The system is distinguished in accordance with another embodiment in that the box is designed to hold at least two individual containers disposed in a battery adjacent to one another. A three-container or four-container battery is particularly advantageous for waste sorting. Multiple combinations too can also be conveniently achieved in this way.

A further embodiment in accordance with another embodiment consists of the box having, preferably at the top and on the rear, a swivel bearing for the cover, so that all individual containers can be inspected from above and are also accessible. In addition, the cover can be cleaned very conveniently in this way. The design furthermore permits, assuming greater expense is no obstacle, the fitting of motor-powered waste crushing and compacting devices.

BRIEF DESCRIPTION OF THE DRAWING

Further features, details and advantages of the invention are stated in the wording of the claims and in the following description of embodiments based on the drawings, in which:

DESCRIPTION OF THE PREFERRED EMBODIMENTS

Figure 1:
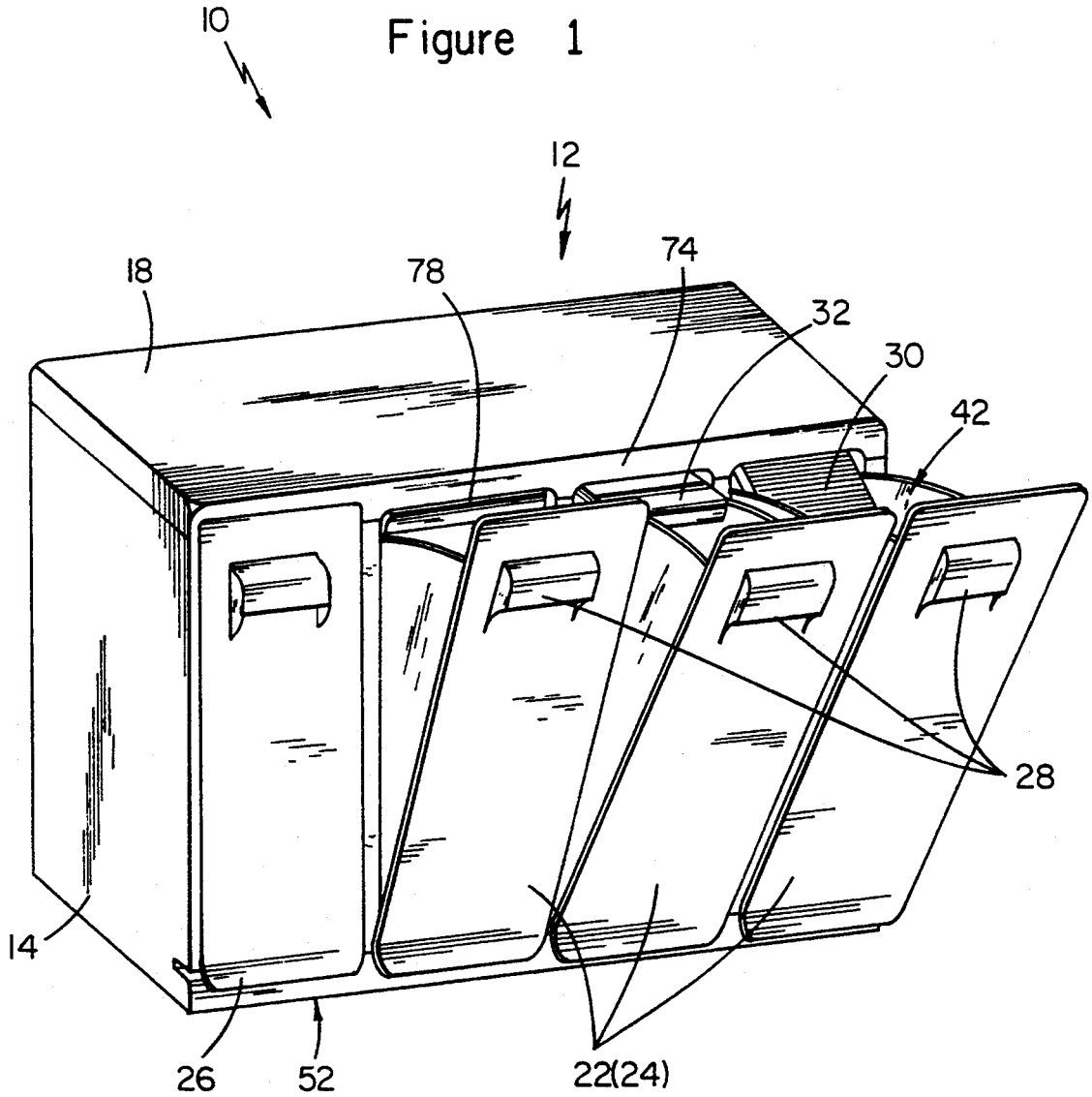
FIG. 1 shows an oblique view of a waste system with four individual containers.

A waste container system in accordance with the invention is designated overall as 10 in FIG. 1. The system has a receptacle box 12 with lateral walls 14, a rear wall 16 (FIGS. 2*a* to 2*e*) and a cover 18 of cover plate type. The receptacle box 12 encloses a stowage space 20 for a number of individual containers 22, of which the front plates 24 close the box 12. A pedal strip 26 is provided on the bottom and a handle 28 on the top for moving the individual container 22 into a tilted position and back again.

The design and the use are shown more clearly in FIGS. 2*a* to 2*e*. Underneath the cover 18 is a manual pressing plate 30 that has a recessed grip 32 at the front and is supported at the rear on sliding bearings 34 inside a lateral guide 40. The sliding bearings 34 can be attached to a rod 36 at the rear narrow side of the manual pressing plate 30 in the form of sliding heads 38 (see FIG. 4).

Figure 2B:
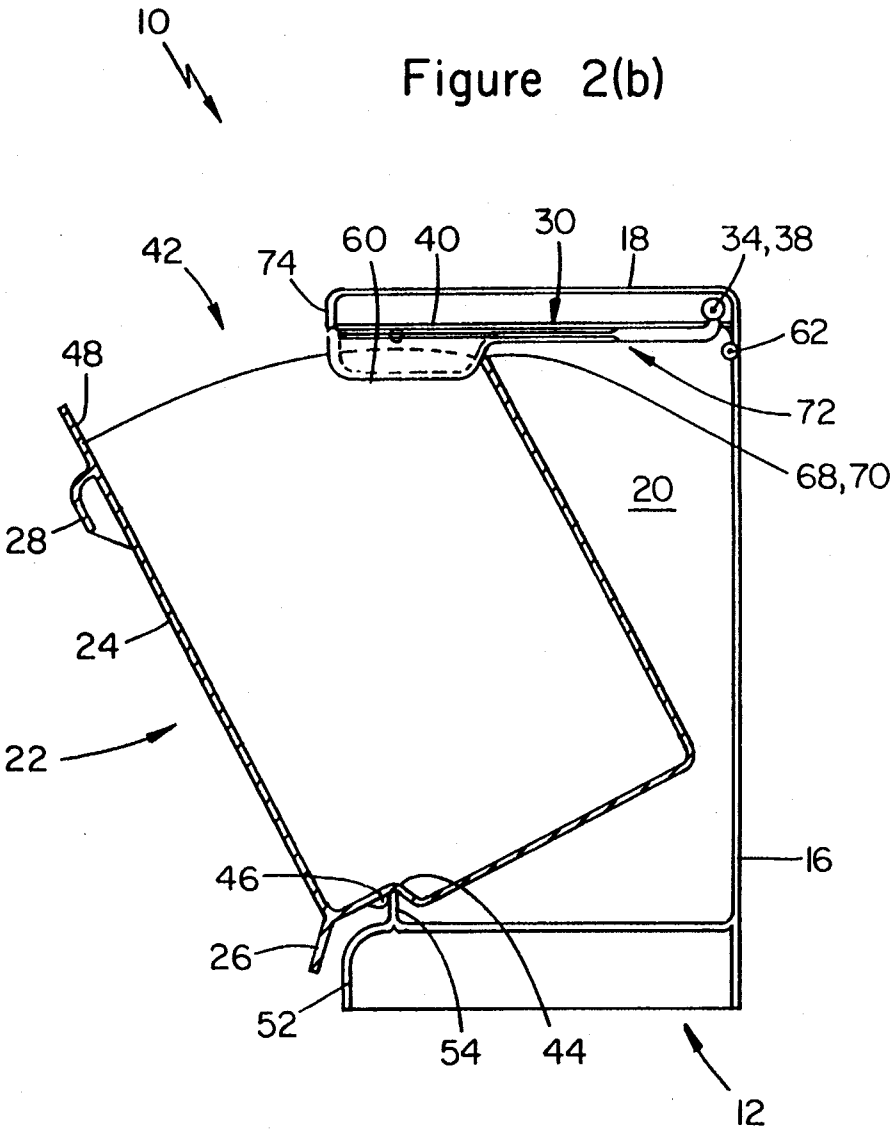
FIG. 2*b* shows a longitudinal sectional view through the container in FIG. 2*a* in partially forward-tilted position.
Figure 2A:
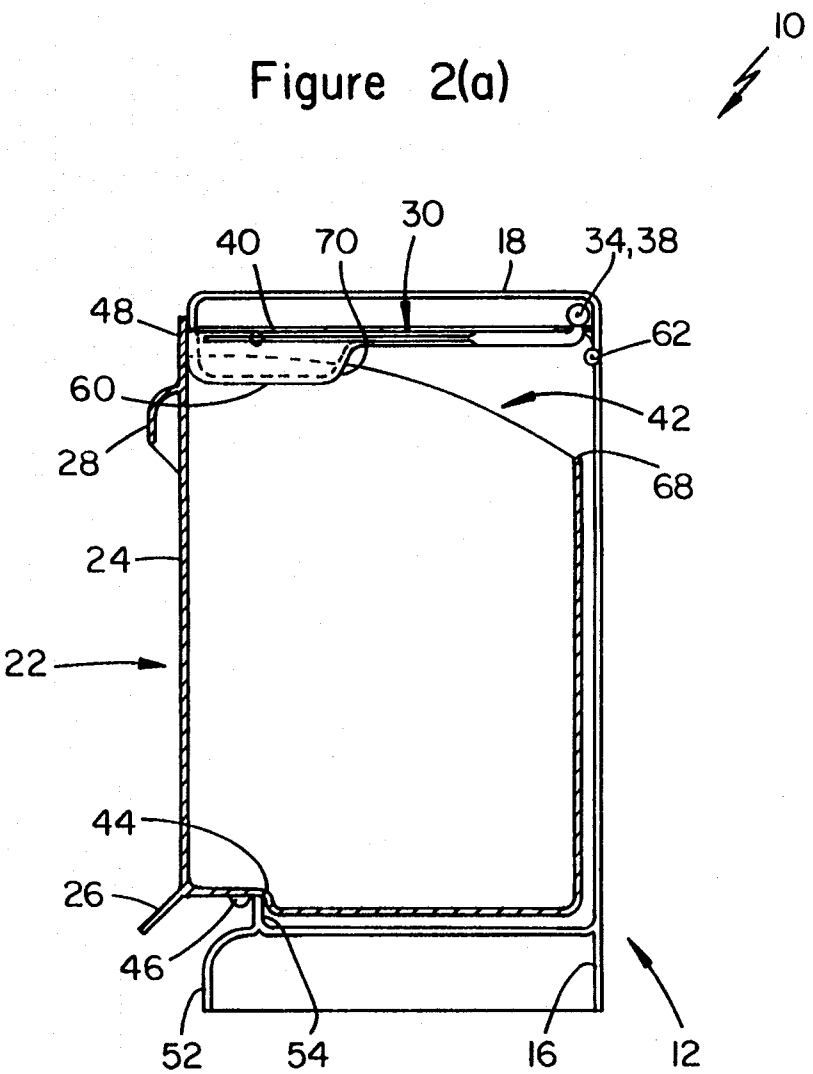
FIG. 2*a* shows a longitudinal sectional view through a waste container in the rest position.
Figure 2D:
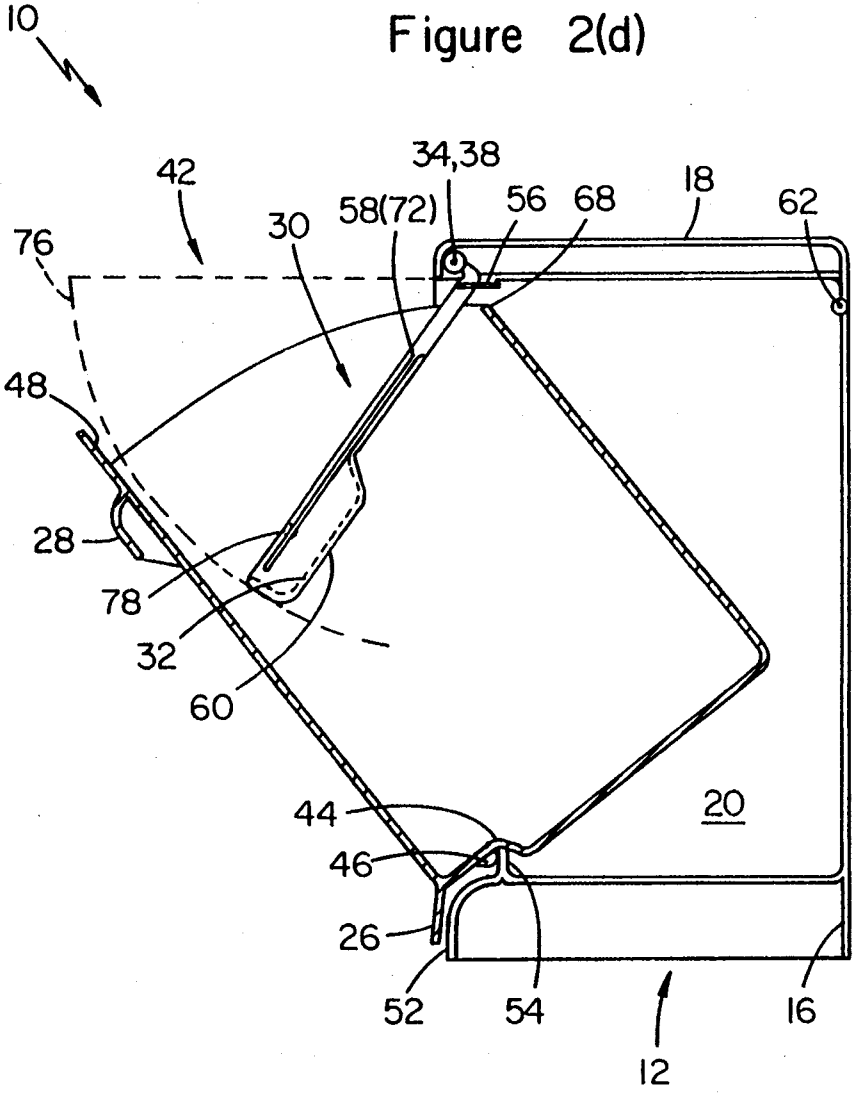
FIG. 2*d* shows a longitudinal sectional view in accordance with FIG. 2*c* with swung-down manual pressing plate.
Figure 2C:
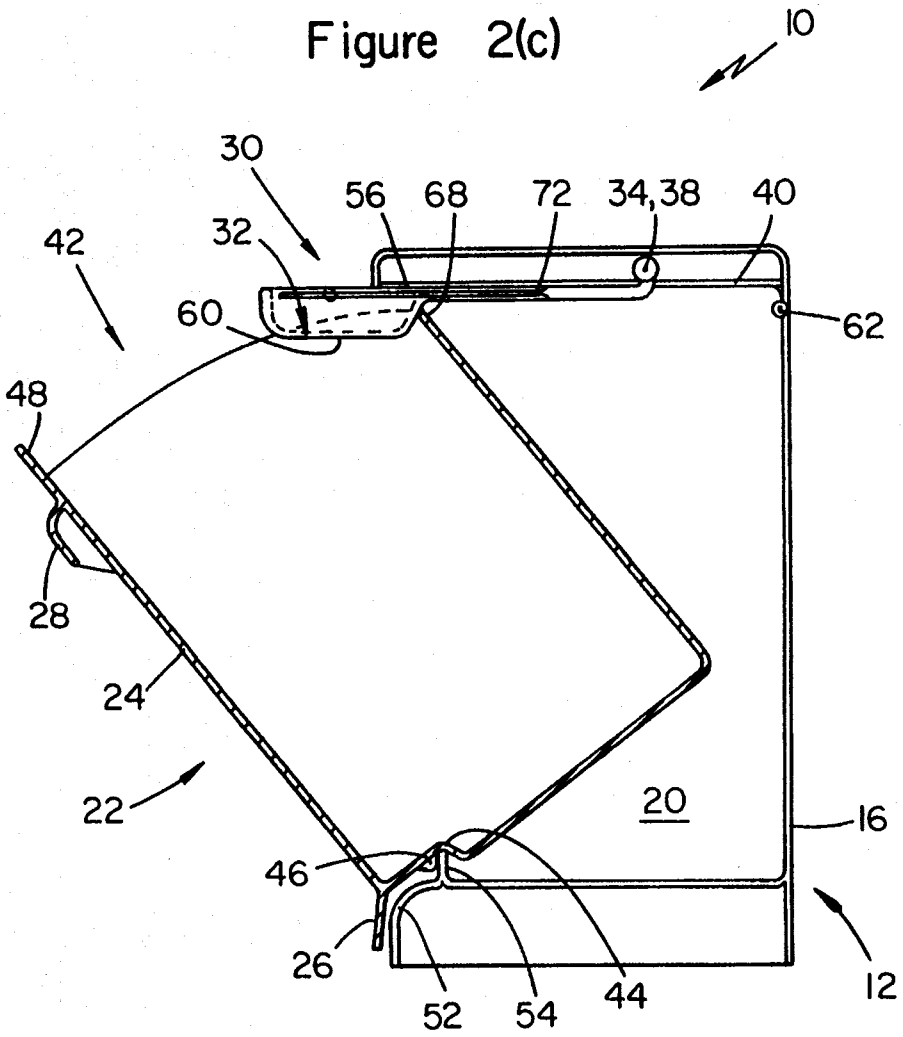
FIG. 2*c* shows a longitudinal sectional view through the individual container in FIGS. 2*a* and 2*b* in fully forward-tilted position.

Each container 22 has an opening 42 at the top for inserting waste with or without a liner (not shown). At the lower end of the container on the front, a depression 44 and a raised cam 46 together form a channel that straddles a rib 54 of a pedestal 52 of the receptacle box 12. It can be seen that a simple tilting bearing is provided in this way that immediately repositions the container 22 when it is put back inside after removal. The manual pressing plate 30 has on both sides sliding grooves 58 whose run-out ends 72 have a fixed distance to the sliding bearings 34/38. On the underside of the manual pressing plate 30 is a pressing element 60 with a rear stop 70 that is pulled along by the rear edge 68 of the individual container 22 as soon as the latter is tilted forward (FIG. 2*b*). This frees the opening 42 for waste insertion. If this waste is to be compressed, the individual container is moved further forwards, either by pressure on the pedal strip 26 or by pulling the handle 28. As a result, the manual pressing plate 30 is pulled further forward at the same time (FIG. 2*c*) so that the sliding bearings 34 move forwards out of their rest position. In a front limit position (FIG. 2*d*), the run-out ends 72 have left the rails 40; the manual pressing plate 30 can now be swung downwards along the path 76 by pressing the recessed grip 32, in order to compress the contents of the individual container 22.

An important guide element for the manual pressing plate 30 is the guide piece 56 near to the front limit position 50 and preventing the sliding bearings 34/38 from slipping out. A handle strip 78 facilitates handling of the manual pressing plate 30 in the area of the recess 32 and forms a lifting handle.

To avoid any odor inconvenience while closed, each individual container 22 has on the front plate 24 a sealing stop 48 at the top, which engages with the front edge 74 of the cover 18. Suitable sealing material (not shown) can enhance the sealing effect at these points.

Figure 2E:
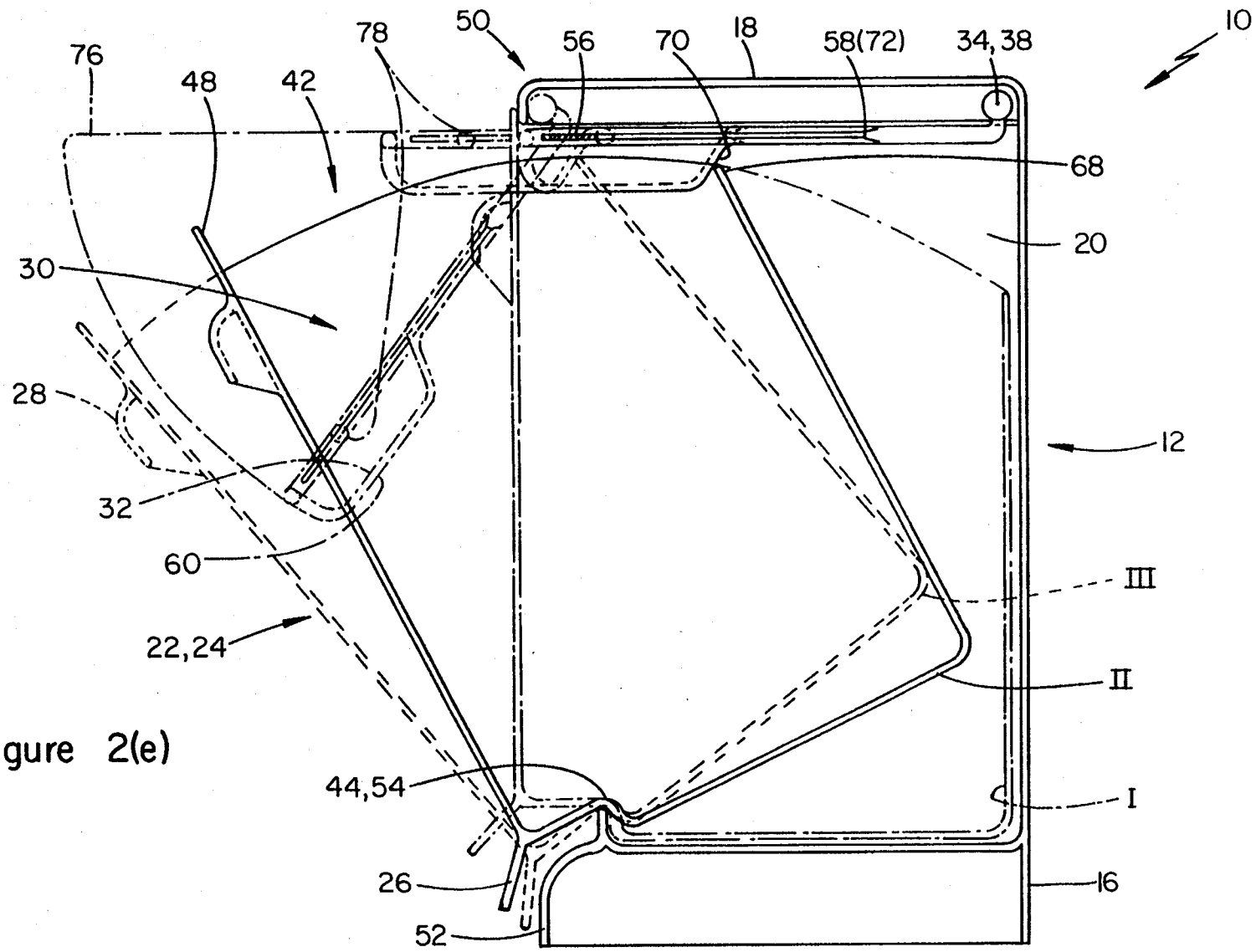
FIG. 2*e* shows a longitudinal sectional view to illustrate the movement sequence in accordance with FIGS. 2*a* to 2*d*.

FIG. 2*e* illustrates the handling of the waste container system 10, by showing its operation at particular junctures. A rest position generally designated as I corresponds to the illustration in FIG. 2*a*. Initial tilting as shown in FIG. 2*b* is omitted, and then position II (corresponding to FIG. 2*c*) is shown, with the rear edge 68 of the individual container 22 having arrived at the stop 70 of the pressing element 60 and the manual pressing plate 30 already moved some way forward. In position III, the individual container 22 is fully tilted forward, the sliding bearings 34, 38 are in their limit positions 50, and the manual pressing plate 30 can therefore be swung into the interior of the container. Once the pressing operation is completed, the manual pressing plate 30 is lifted with the handle strip 78 and slid back to the horizontal position on the sliding guide 40/58, with the stop 70 already pulling the rear edge 68 of the individual container 22. The container 22 is swung back into the rest position I using the handle 28.

Figure 3:
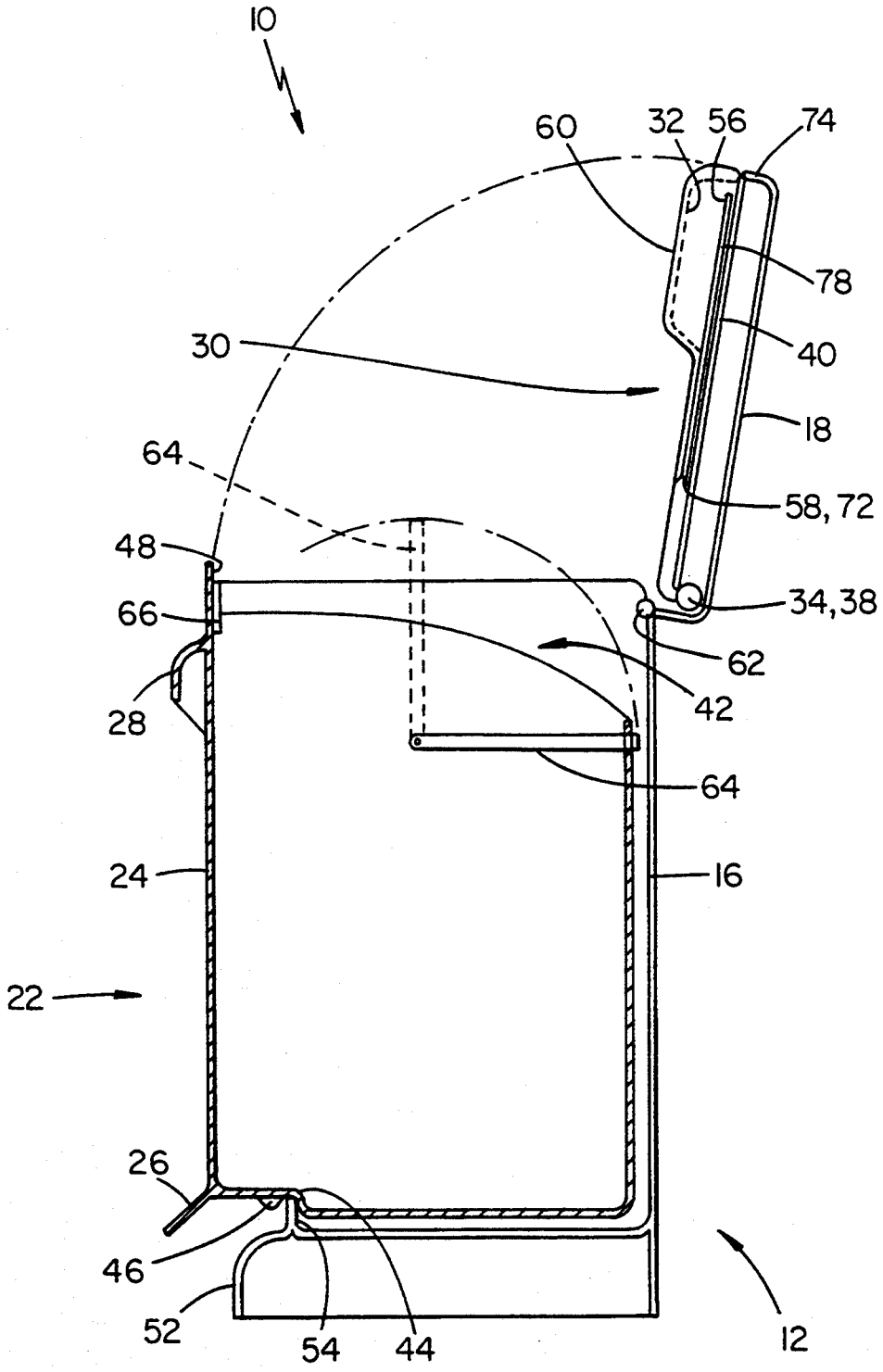
FIG. 3 shows a longitudinal sectional view similar to that in FIG. 2*a* with swung-up cover.

Variants are shown in FIG. 3, where one may note a swivel bearing 62 for the cover 18, which is drawn in the open setting. The receptacle box 12 is therefore freely accessible from above and can be inspected completely.

The underside of the cover 18 together with manual pressing plate 30 and pressing element 60 is then convenient for cleaning. Furthermore, it can be seen at a glance how full the individual containers 22 of the system 10 are.

Each individual container 22 can be provided with a carrying handle 64 that can be swung to the rear when not in use, as shown by the unbroken line, but can also be swung upwards (dashed line) and forwards to engage in a recess 66. A handle 64 of this type can hold in place a liner (not shown).

It can further be seen in FIG. 3 that the individual container 22 can have gentler curves at its bottom end, as indicated by the dotted line. This contributes greatly to complete removal of all residues and to better cleaning overall.

Figure 4:
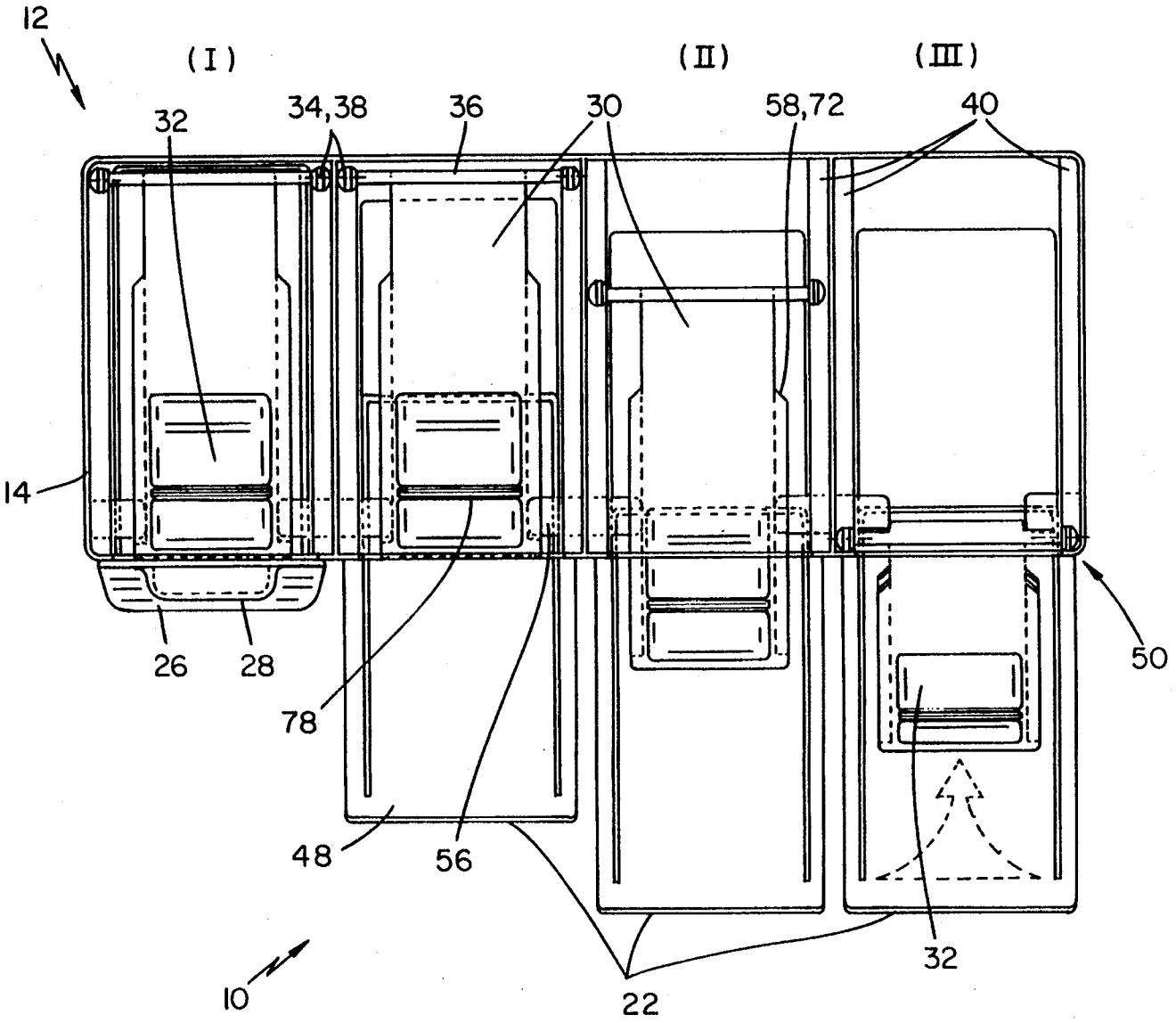
FIG. 4 shows a diagrammatic plan view of the waste container system in FIG. 1 with the cover removed.

The diagrammatic plan view in FIG. 4 shows the system 10 once again with differing positions of the four individual containers 22 in use here. On the left is the rest position (I in FIG. 2*c*). The adjacent individual container 22 is already partially tilted, but the manual pressing plate 30 is still in its rest position. The following container 22 has reached the intermediate position (II, FIG. 2*c*), in which the manual pressing plate 30 has already been extended part way and the individual container 22 is completely tilted. On the far right, the working position III is shown, in which the extended manual pressing plate 30 can be pressed downwards, as indicated in the diagram by a dash-dotted arrow.

FIG. 4 also shows that the individual containers 22 can be separated from one another by partitions (not illustrated), although for this .purpose floor strips corresponding to the arrangement of the lateral guides 40 in the cover plate are also sufficient. Here too, the sliding heads 38 of the sliding bearings 34 are separated from one another by walls of the lateral guides 40.

The invention is not confined to the embodiments shown. It can however be seen that a preferred waste container system 10 has a receptacle box 12 with stowage space 20 for individual containers 22 that can be tilted forward and removed. Each of these containers has allocated to it, and underneath a cover 18, a manual pressing plate 30 that can be pulled forward in sliding guides 40, 58 and swung down to its limit position 10, said plate having a sliding/pivoting bearing 34 on each side at the rear. A pressing element 60 projects inwards/downwards from the underside of the manual pressing plate 30, the upper side of said element forming a recess 32 accessible from above/outside and having a handle strip 78. A stop 70 on the pressing element 60 is pulled forward by the upper rear edge 68 of the individual container 22 as the latter is tilted forwards. The individual container 22 is supported by means of a depression 44 provided at the front and on the bottom and resting on a rib 54 of a pedestal 52 inside the receptacle box 12, and can be tilted forwards optionally using a pedal strip 26 or a handle 28 and/or removed using a carrying handle 64. A sealing stop 48 on the top of the front plate 24 engages with the front edge 74 of the cover 18 when the container is in its rest position. The box 12 holds at least two individual containers 22 disposed in a battery adjacent to one another. A swivel bearing for the cover 18 can be provided at the top on the rear wall.

All features and advantages proceeding from the claims, the description and the drawing, including design details and spatial arrangements, can be substantial to the invention both individually and in a wide variety of combinations.

I claim:

1. A waste container system (10) comprising:
a receptacle box (12);
said receptacle box including side walls (14), a rear wall (16), and a cover (18) over said side walls and said rear wall,
said side walls, said rear wall and said cover defining a storage space (20) for at least one individual container (22),
said container being underneath a compactor (30) and being tiltable in a forward direction relative to said rear wall,
said compactor comprising a manually operable movable pressing plate (30),
said pressing plate including guiding means (40, 58) for enabling movement of said pressing plate in the forward direction up to a position of a front limit (50) and swinging means (34, 38) for enabling downward swing movement of said pressing plate into said container when said container is in a forward tilted position.

2. System according to claim 1, wherein said container and said pressing plate have a substantially oblong basic form including narrow sides facing in the forward direction and in a rearward direction into the receptacle box (12) and wide sides parallel to said side walls (14).

3. System according to claim 1, wherein each wide side of said pressing plate (30) has at its rear a sliding bearing (34) that doubles as a pivot bearing when said pressing plate is in said position of the front limit.

4. System according to claim 3, wherein said guiding means of said pressing plate (30) include, on either side of said pressing plate, lateral sliding grooves (58) having run-out ends (72) opening towards the rear and further include lateral rails (40) parallel to said side walls (14) of said receptacle box (12), said ends (72) leaving said rails (40) when said pressing plate is in said position of the front limit such that the downward swing movement of said pressing plate (30) about said bearings (34) is enabled.

5. System according to claim 3, wherein said sliding bearings (34) include sliding heads (38) that project, on either side of said pressing plate (30), from a rod (36) located on the rear narrow side.

6. System according to claim 1, wherein said pressing plate (30) has on its underside a pressing element (60) projecting into said container (22).

7. System according to claim 6, wherein a recessed grip (32) is provided on said pressing plate (30) accessible from outside said receptacle box (12) when said pressing plate (30) is moved towards said position of the front limit.

8. System according to claim 7, wherein said recessed grip (32) forms an upper side of said pressing element (60) and is topped by a handle strip (78).

9. System according to claim 6, wherein said pressing element (60) is flexible.

10. System according to claim 6, wherein said pressing element (60) includes a stop (70), an upper rear edge

(68) of said container (22) disposed relative to said stop in such a manner that, as said container is tilted, said pressing plate (30) is engaged by said upper rear edge (68) and is pulled in said forward direction.

11. System according to claim 10, wherein said stop comprises a rear portion of said pressing element (60).

12. System according to claim 1, wherein a forward bottom portion of said container (22) comprises a support depression (44) adapted to rest on a rib (54) of a pedestal (52) inside said receptacle box (12), said rib (54) acting as a tilting bearing.

13. System according to claim 1, wherein said container (22) includes a front plate (24), and said front plate (24) has at its top a sealing stop (48) for engaging a front edge (74) of said cover (18) when said container (22) is in a rest position.

14. System according to claim 1, wherein said container (22) includes handling means, including a pedal strip (26) and a handle (28, 64).

15. System according to claim 1, wherein said side walls, said rear wall and said cover of said receptacle box (12) define a storage space (20) for at least two individual containers (22) disposed in a battery adjacent to one another.

16. System according to claim 1, wherein said receptacle box (12) includes a swivel bearing (62) for said cover (18) at the top of said rear wall (16).

17. A waste container system comprising (a) a receptacle box (12) having side walls (14) and a rear wall (16) which define a storage space (20), and a cover (18) for said storage space (20), (b) at least two containers (22) positioned side by side in said receptacle box (12), each container (22) having an open top, being tiltable in a forward direction relative to said rear wall (16) and being removable from said receptacle box (12), and (c) a compacting arm (30) mounted below said cover (18) above the open top of each container (22), said compacting arm (30) being slidable and pivotable relative to the underside of said cover (18) into a position which permits downward manual compaction of the contents of a respective container (22).

* * * * *